US007181773B1

(12) United States Patent
Piraka

(10) Patent No.: US 7,181,773 B1
(45) Date of Patent: Feb. 27, 2007

(54) HOSPITAL GOWN

(76) Inventor: Mahin Piraka, 21257 Woodfarm Dr., Northville, MI (US) 48167

( * ) Notice: Subject to any disclaimer, the term of this patent is extended or adjusted under 35 U.S.C. 154(b) by 0 days.

(21) Appl. No.: 11/193,190

(22) Filed: Aug. 1, 2005

(51) Int. Cl.
*A41D 13/00* (2006.01)

(52) U.S. Cl. ..... 2/114; 2/69

(58) Field of Classification Search ..... 2/114, 2/104, 69, 103, 105, 106, 115, 79, 80, 83, 2/73, 78.1–78.4; 128/849, 853, 854, 869, 128/873, 875, 876, 877
See application file for complete search history.

(56) References Cited

U.S. PATENT DOCUMENTS 818,351 A * 4/1906 Clark ..... 2/114
1,998,051 A * 4/1935 Gerber ..... 2/114
3,116,491 A * 1/1964 Previdi et al. ..... 2/106
3,799,161 A * 3/1974 Collins ..... 128/854
4,144,593 A * 3/1979 Timmons ..... 2/104
5,093,932 A * 3/1992 Doyle ..... 2/114
5,991,923 A * 11/1999 Maria ..... 2/83

* cited by examiner

*Primary Examiner*—Gloria M. Hale
(74) *Attorney, Agent, or Firm*—Alex Rhodes

(57) ABSTRACT

A hospital gown for medical procedures such as inserting catheters, heart monitoring, wound dressing and the like and reducing exposure of the patient's "private areas". The gown has a large upper opening extending across the front of the gown from about the area of the left clavicle of the patient to about the area of the right clavicle of the patient and an arcuate lower portion extending downwardly to about the descending aorta of the patient; a detachable panel for covering the large upper opening; a narrow opening extending across the front of the gown for uncovering portions of the patient's abdomen; a panel for covering the narrow opening; a storage pocket on a front portion of the large upper opening panel; a pair of divided lower side portions for uncovering portions of the patient's groin; and a plurality of fasteners for joining the panels to peripheries of the openings.

10 Claims, 5 Drawing Sheets

HOSPITAL GOWN

FIELD OF THE INVENTION

This invention relates to hospital garments and more particularly to a hospital gown for preserving a patient's modesty while allowing quick and easy access to selected body areas.

BACKGROUND OF THE INVENTION

Hospital gowns are typically knee length garments, consisting of large sheets of cloth materials with neck and waist ties. They are put on while patients are standing, laying or sitting and are retained by joining the neck and waist ties at the backsides of patients. Although numerous alternatives to current gowns have been developed, as yet none have been accepted because of complexity, high cost and functional limitations.

The standard hospital gown has several drawbacks. One drawback is that body areas which are generally considered "private areas" are exposed when they are uncovered for examinations and procedures, such as wound dressings, injections, suture removals, heart monitoring, telemetry hook-ups and feed line insertions. Exposure of "private areas" embarrasses many patients, particularly female and religious patients, and in some cases causes patient stress.

Another drawback is that during many examinations and procedures patients must be elevated or turned to release neck or waist ties and raise hospital gowns. Elevating and turning patients are not easy tasks, particularly when only a single nurse is available and patients are heavy and/or have limited mobility. In some cases, examinations and procedures are delayed until sufficient resources are available for lifting and turning patients. Another drawback is that elevating and turning patients causes discomfort in some patients. Still yet another drawback is that large body areas are needlessly exposed to contamination and infection. Still yet another drawback is that provisions are unavailable in gowns for storing records, medications such as nitroglycerine, and devices such as heart monitors when patients are moved or otherwise are out of bed.

SUMMARY OF THE INVENTION

With the above drawbacks in mind, it will be appreciated that the present invention is a substantial improvement over the prior art. One benefit of the invention is that selected body areas can be accessed for examinations and procedures without uncovering "private areas". Another benefit, in addition to the foregoing benefit, is that critical body areas can be quickly exposed for emergency procedures, such as transfusions, injections and heart monitoring without elevating or turning patients. This benefit is particularly important in intensive care (ICU) and cardiac units where time is of the essence and immediate actions are required. Another benefit, in addition to the foregoing benefits, is the entire torso of a patient can be uncovered without elevating or turning the patient. Another benefit, in addition to the foregoing benefits, is that it reduces the workload of a hospital nurse. Another benefit is that a means is provided in a hospital gown for storing objects, such as records, medications and electronic monitoring devices.

The invention is an easy to use hospital gown having a pair of openings, a pair of covering panels, and a pair of divided lower portions for quick and easy access to selected areas of the patient. In a first aspect of the invention, a large opening is provided on the front of the gown for uncovering areas of the patient's shoulders, chest, and breasts. The opening is covered with a removable panel having a plurality of quick release fasteners that allow the panel to be partially opened for uncovering the selected areas.

Below the large opening there is a small narrow transverse opening for uncovering the patient's abdomen. The narrow opening is covered with a panel which is attached to the gown along an upper margin and a quick release fastener in the center of a lower margin. The lower side portions of the gown are divided for uncovering portions of the patent's groin. Lower end portions of the divided portions are joined with quick release fasteners.

In a second aspect of the invention, a larger rectangular abdominal opening is covered with a detachable panel. In a third aspect of the invention, the large opening and smaller abdominal opening are covered with a single detachable panel. The panels of the second and third aspects are attached to the gown with quick release fasteners that allow quick and easy access to selected body areas.

In employing the teaching of the present invention, a plurality of alternate constructions can be provided to achieve the desired results and capabilities. In this disclosure, only several embodiments are presented for the purpose of disclosing my invention. However, these embodiments are intended as examples only and should not be considered as limiting the scope of my invention.

The foregoing features, benefits, objects and best mode of practicing the invention and additional benefits and objects will become apparent from the ensuing detailed description of a preferred embodiment and the subject matter in which exclusive property rights are claimed is set forth in the numbered claims which are appended to the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating a presently preferred specific embodiment of the invention by way of non-limiting example only.

DETAILED DESCRIPTION OF A PREFERRED EMBODIMENT

Figure 1:
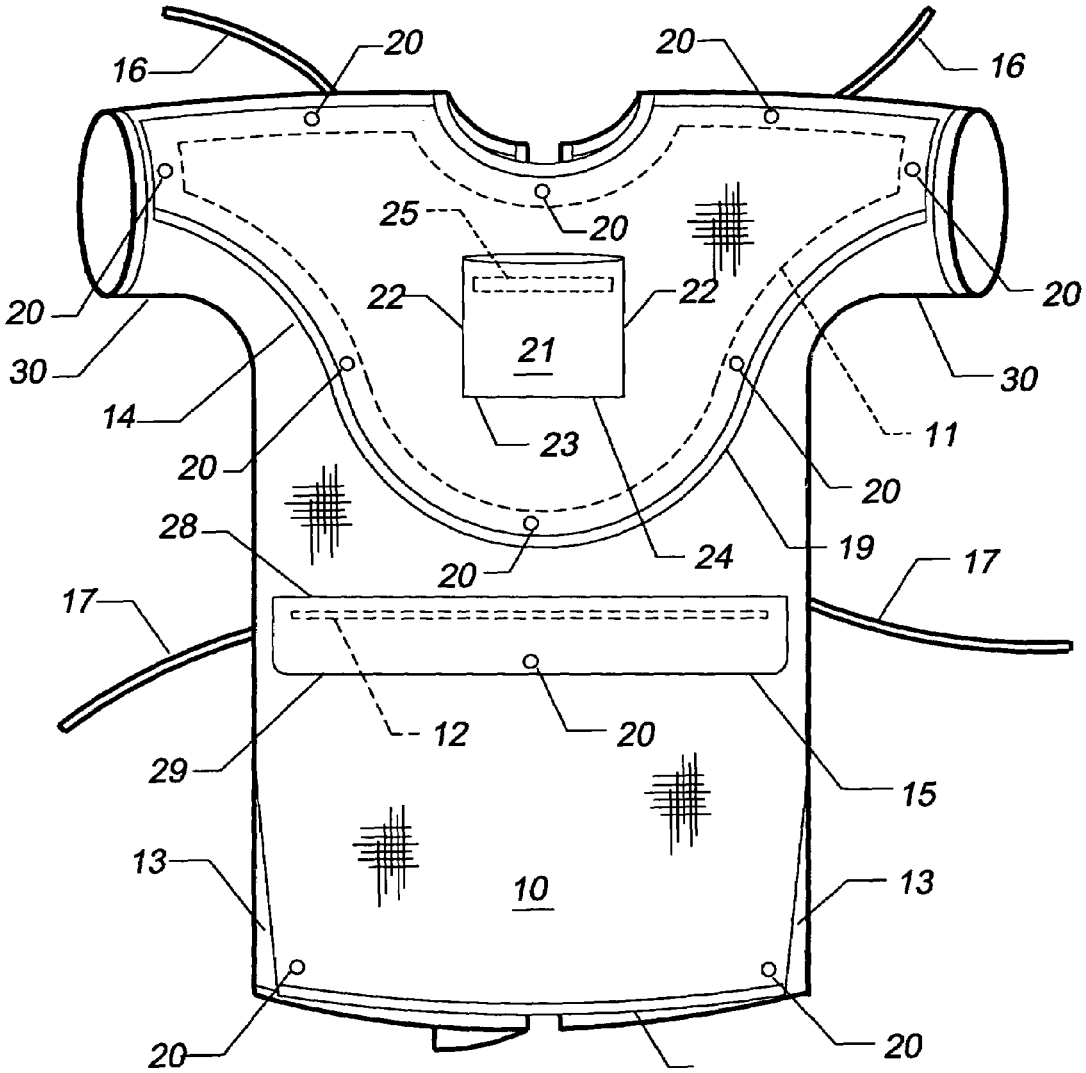
FIG. 1 is a front view of a hospital gown according to the present invention.
Figure 3:
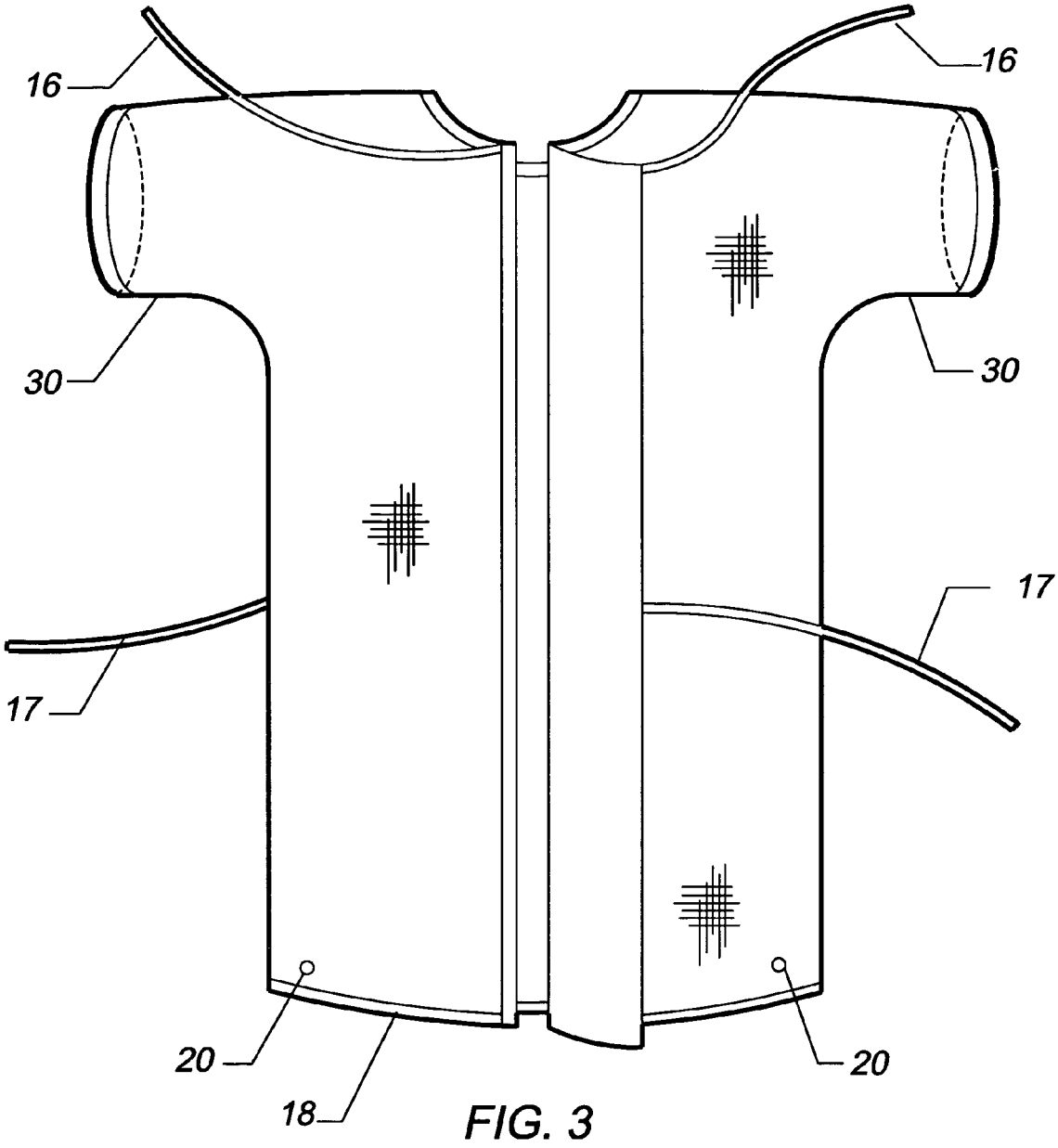
FIG. 3 is a rear view of the hospital gown.

Referring now to the drawings wherein like numerals designate like and corresponding parts, in FIGS. 1 and 3, a hospital gown 10 is shown for preserving a patient's modesty while uncovering selected body areas for examinations and medical treatments. The hospital gown 10 is a short sleeve three-quarter length garment, with two openings 11, 12 on the front of the gown 10, a pair of divided lower portions 13, a pair of panels 14, 15 for closing the openings 11, 12, quick release fasteners 20 for attaching the panels 14, 15 to the gown 10, and ties 16, 17 to retain the gown 10 on the patient.

The gown 10 is reusable and made of thin sheets of fabric, such as cotton, rayon and polyester but may also be made of disposable fibrous or plastic materials. The borders of the gown 10 are preferably reinforced with hems 18. On the upper portion of the gown 10 is a large opening 11 with an arcuate lower margin 19. The opening 11 extends laterally for almost the entire width of the gown 10 and downwardly to approximately the mid portion of the gown 10. The opening 11 is covered with one of the panels 14 which is detachable.

Figure 2:
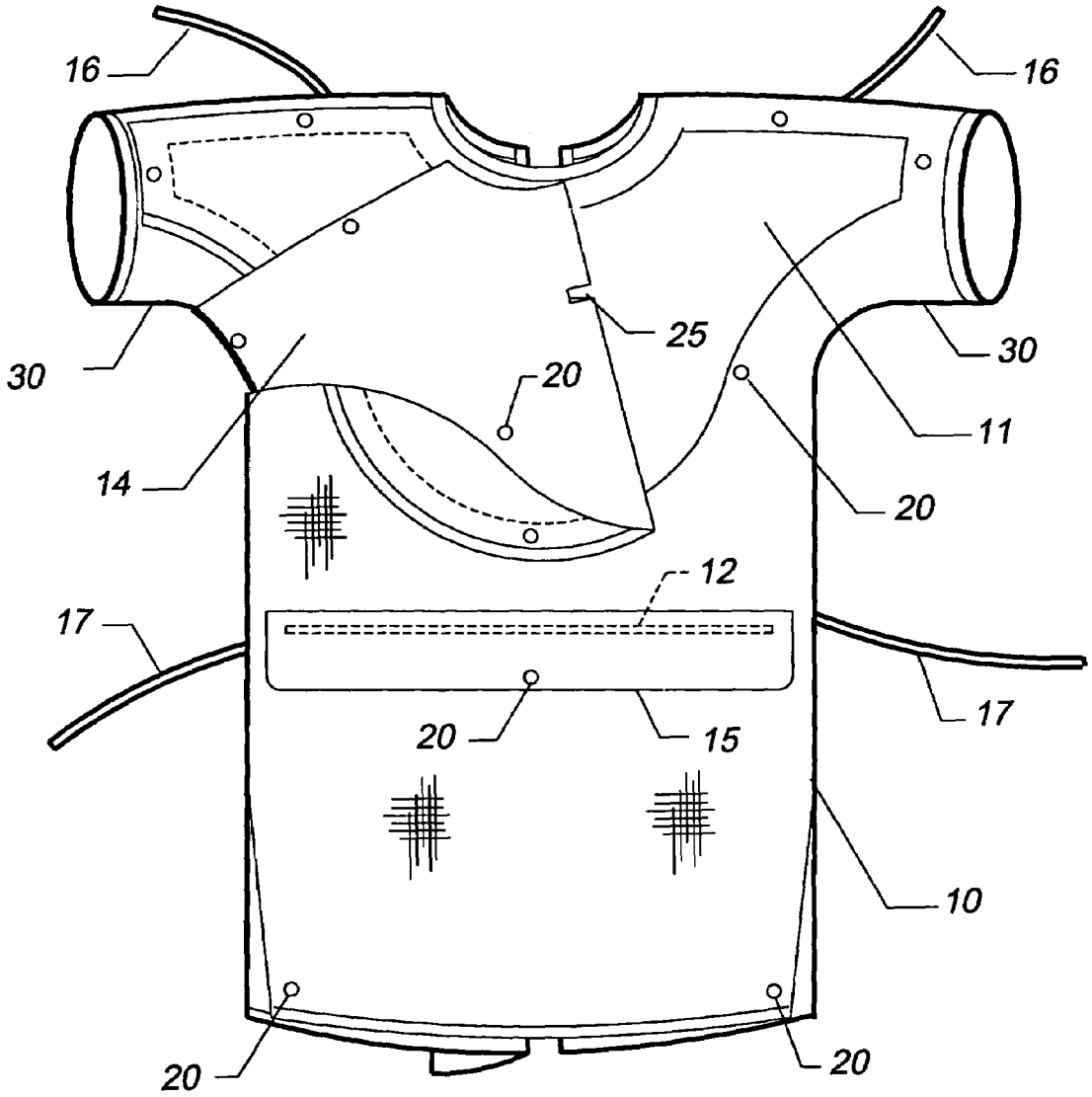
FIG. 2 is a front view of the hospital gown showing a panel partially open to access a portion of the chest wall.

The large opening 11 and panel 14 are important features of my invention. As shown in FIG. 2, they allow quick and easy access to selected areas of shoulders, breast and chest for examinations and procedures such as wound dressings, heart monitoring, sutures, injections, insertions of catheters, chemotherapy ports, etc. without embarrassing the patient by unnecessarily exposing "private areas". The opening 11 also eliminates the need of elevating or turning the patient, or untying the neck 16 and waist 17 ties to expose selected areas.

With reference to FIG. 1, the periphery of the large detachable panel 14 is joined to the gown 10 with a series of spaced apart conventional snap fasteners 20 or another widely used quick release fastener such as a zipper, button or hook and loop type fastener. The positions and numbers of fasteners 20 may vary somewhat from what is shown in FIG. 1. As shown in FIG. 2, the large detachable panel 14 and quick release snap fasteners 20 permit a physician, nurse or medical technician to quickly and easily uncover only a small portion of the patient's shoulders, chest and breasts by separating certain snap fasteners without unnecessarily affecting the patient's privacy.

On the front of the detachable panel 14 there is a small rectangular pocket 21 formed by joining the side 22 and bottom 23 margins of a small rectangular sheet of fabric 24 to the detachable panel 14. The top of the pocket 21 is open for storing objects such as records, medications and electronic monitors. In the pocket 21, directly behind the small rectangular sheet 24, is an aperture 25 for routing wiring to the patient's chest wall or an area such as a nurse's station. The pocket 21 provides several important benefits. One benefit is that it establishes a standard location for storing records, medications and electronic monitors, thereby reducing the number of lost or misplaced articles. Another benefit is that it reduces the amount of damage to monitors caused by impacts and falls. Another benefit is that it provides storage for these articles when patients are transported to areas such as X-Ray rooms, or are otherwise out of bed.

Referring again to FIG. 1, below the large opening 11 which allows access to the patient's shoulders and chest wall, is a narrow transverse opening 26 for quick and easy access to the patient's abdominal areas. As shown in FIG. 1, the opening 12 extends along almost the entire width of the gown 10 whereby the upper and lower margins of the opening 12 can be spread apart to an extent that allows easy access to the entire abdominal area. The transverse opening 26 is covered with a detachable panel 15 that is joined to the gown 10 along a top margin 28 by sewing and along a bottom margin 29 to the gown 10 with a single conventional snap 20 or other widely used fastener, such as a button, zipper or hook and loop type fastener.

As shown in FIG. 1, bottom portions 13 of the sides of the gown 10 are divided for a short distance to allow easy access to the patent's groin and pelvic areas. The lowermost corners of the divided portions 13 are joined together with conventional snaps 20 or other suitable fasteners.

With reference to FIG. 3, on the back of the gown are neck 16 and waist 17 ties to retain the gown 10 on the patient. The method for installing the gown 10 on the patient is conventional, wherein the arms of a standing or sitting patient are passed through the short sleeves 30 and end portions of the neck 16 and waist 17 ties are joined together.

Figure 4:
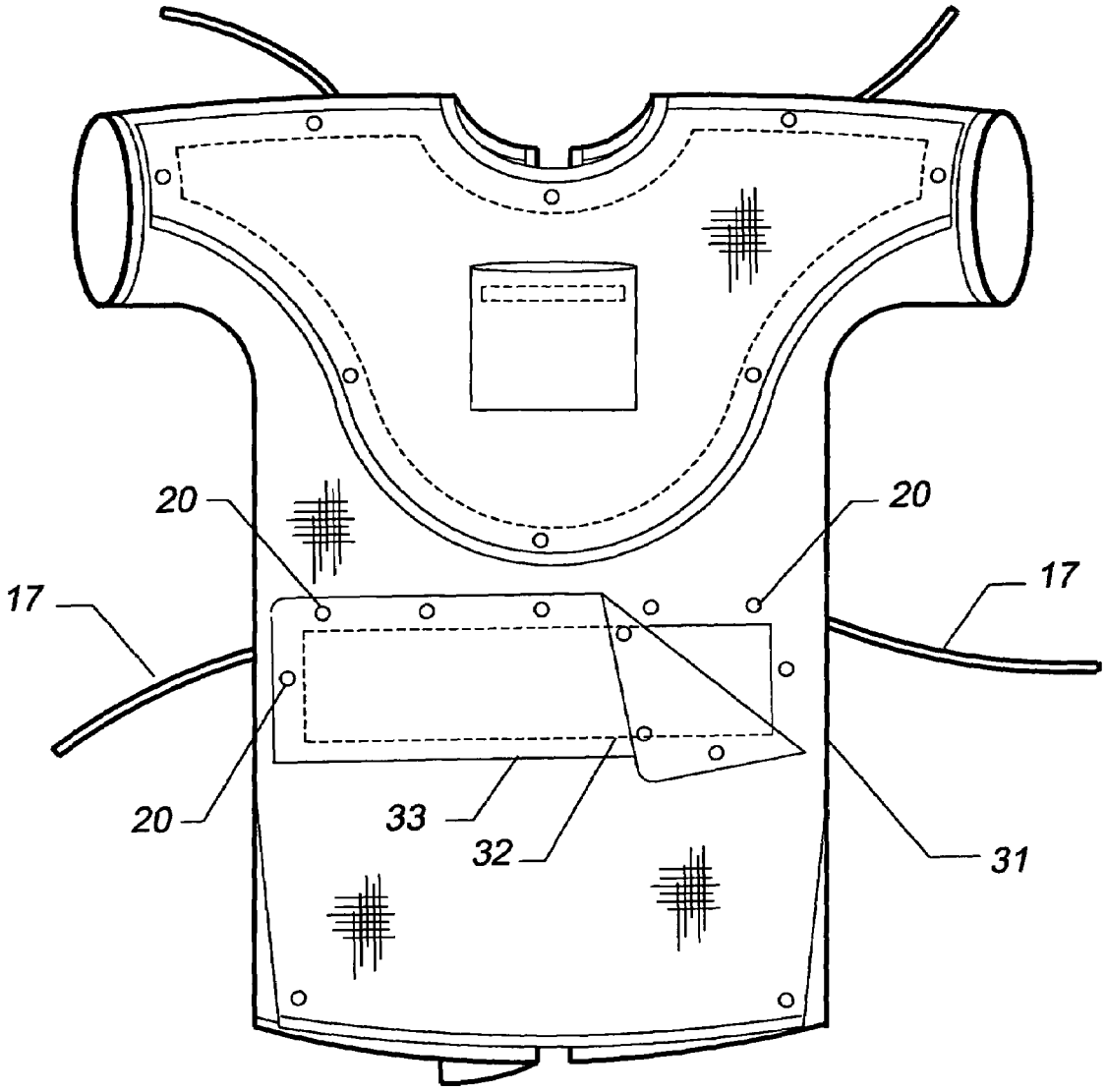
FIG. 4 is a front view of an alternate embodiment of the hospital gown.

Referring now to FIG. 4, an alternate embodiment 31 is shown wherein an enlarged rectangular opening 32 and a detachable panel 33 are provided for access to the abdominal area, and snap type fasteners 20 along top and side margins allow access to specific portions of the abdominal area.

Figure 5:
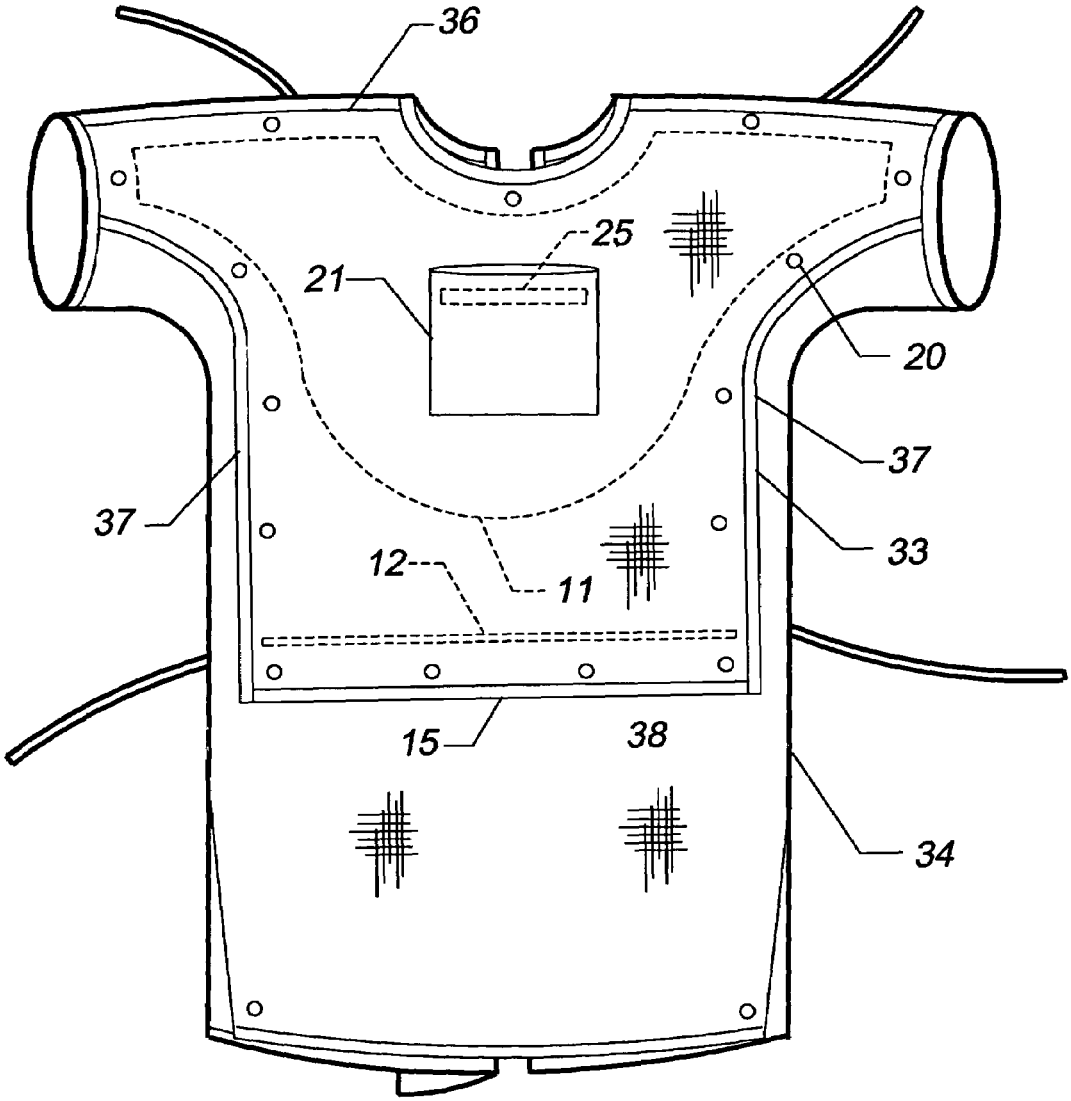
FIG. 5 is a front view of a second alternate embodiment.

With reference to FIG. 5, an embodiment 34 is shown wherein the same openings 11, 12 are provided in a hospital gown 34 as the first embodiment 10 and a single detachable panel 35 is provided which covers the openings 11, 12. The panel 35 is attached to the gown 10 with snap fasteners 20 along the top 36, side 37 and bottom 38 margins of the panel 35.

From the foregoing it will be apparent that my invention is a substantial improvement over current hospital gowns, by way of example, it is easy to use, provides easy access to body areas, does not violate the modesty of a patient, and reduces the burden of hospital nurses.

Although only several embodiments of my invention have been disclosed and particularly described for the purpose of disclosing my invention and the manner of using the invention, it is not my intention to limit my invention to the described embodiments, since other embodiments can be developed from this disclosure by persons skilled in the relevant art by such changes as the substitutions of parts and materials known to persons skilled in the art, eliminations of parts, inversions of parts and other obvious modifications and changes. By way of example, in lieu of the use of neck and waist ties, other fasteners, such as Velcro®), can be used or fasteners eliminated entirely by a "slip over" retention without departing from the principles of my invention.

I claim:

1. A hospital gown for quick and easy access to areas of a patient during medical procedures such as inserting catheters, heart monitoring, wound dressing and the like, said gown having a large opening in a front of said gown, said opening having a wide upper portion extending laterally across said front of said gown from the area of the left clavicle of said patient to the area of the right clavicle of said patient and an arcuate lower portion extending downwardly to about the descending aorta of said patent for selectively uncovering portions of said patient's shoulders, chest and breasts to perform such tasks as attaching harnesses for patient monitoring, installing pick and chemotherapy lines; a first panel for covering said large frontal opening; a narrow rectangular shaped opening in the front of said gown below said large opening, said narrow rectangular shaped opening extending laterally across said front of said gown for uncovering portions of said patent's abdomen to perform such tasks as replacing colostomy bags and dressing surgical incisions; a second panel for covering said narrow rectangular shaped opening; and a plurality of quick release spaced apart fasteners located around a periphery of each of said panels for attaching said panels to said gown and for quickly and easily uncovering selected areas of patient while limiting exposure of said patient's "private areas".

2. The hospital gown recited in claim 1 further comprising a rectangular pocket on a front portion of said large opening panel for storing an article such as an electronic monitor, said pocket having side and bottom margins joined to said panel and an open top portion for inserting said monitor and an opening in gown for connecting a wiring harness to said monitor.

3. The hospital gown recited in claim 1 wherein said gown is reusable and is made of a fabric such as cotton, rayon or polyester.

4. The hospital gown recited in claim 1 wherein said gown is made of a disposable flexible material.

5. The hospital gown recited in claim 1 further comprising a pair of neck and shoulder ties for retaining said gown on said patient.

6. The hospital gown recited in claim 1 further comprising a pair of divided lower side portions for selectively uncovering portions of said patent's groin.

7. The hospital gown recited in claim 1 wherein said quick release fasteners are snap fasteners.

8. The hospital gown recited in claim 1 wherein said quick release fasteners are hook and loop type fasteners.

9. A hospital gown for quick and easy access to areas of a patient during medical procedures such as inserting catheters, heart monitoring, wound dressing and the like, said gown having a large upper opening in an upper front portion of said gown, said opening having an upper portion extending across the width of said gown from the area of said patient's left clavicle to the area of said patient's right clavicle and an arcuate lower portion extending downwardly to said patient's descending aorta for uncovering portions of said patient's shoulders, breasts and chest; a narrow rectangular shaped opening below said large upper opening on said front of said gown, said narrow rectangular shaped opening extending across said width of said gown for uncovering portions of said patient's abdomen; a first panel for covering said shaped large upper opening; a second panel for covering said narrow rectangular shaped opening; a plurality of quick release fasteners for attaching said panels to the peripheries of said openings; a storage pocket on a front portion of said first panel; a pair of divided lower side portions for uncovering portions of said patient's groin; a quick release means for attaching said panels to said openings; and neck and waist ties for retaining said gown on said patient.

10. A hospital gown for quick and easy access to areas of a patient for performing medical procedures such as inserting catheters, heart monitoring, wound dressing and the like and reducing exposure of said patient's "private areas", said gown having a large upper opening with a wide upper portion extending across a front of said gown from the area of said patient's left clavicle to the area of said patient's right clavicle and an arcuate lower portion extending downwardly to about said patient's descending aorta for uncovering portions of said patient's shoulders, breasts and chest; a narrow opening below said large upper opening, said narrow opening extending across said front of said gown for uncovering portions of said patient's abdomen; a panel for covering said upper and said narrow lower opening; a storage pocket on a front portion of said panel; a pair of divided lower side portions for uncovering portions of said patient's groin; and a plurality of spaced apart quick release fasteners for joining said panels to peripheries of said openings.

* * * * *